US007484331B2

(12) United States Patent
El Jalkh

(10) Patent No.: US 7,484,331 B2
(45) Date of Patent: Feb. 3, 2009

(54) ANTI-TILTING, PIVOTABLE, SLIDING PANELS

(76) Inventor: Samir aziz El Jalkh, Bldg. 3, St. 3, Mtaileb, Rabieh, Metn, Beirut (LB)

( * ) Notice: Subject to any disclaimer, the term of this patent is extended or adjusted under 35 U.S.C. 154(b) by 528 days.

(21) Appl. No.: 11/190,282

(22) Filed: Jul. 26, 2005

(65) Prior Publication Data

US 2006/0037246 A1 Feb. 23, 2006

Related U.S. Application Data

(60) Provisional application No. 60/602,387, filed on Aug. 17, 2004.

(51) Int. Cl.
*E05D 15/58* (2006.01)

(52) U.S. Cl. ..... 49/260; 49/176; 49/258

(58) Field of Classification Search ..... 49/118, 49/260, 333, 335–337, 362, 506, 216, 218, 49/219, 223, 261, 425
See application file for complete search history.

(56) References Cited

U.S. PATENT DOCUMENTS 1,910,344 A * 5/1933 Kotler ..... 49/260
4,641,896 A * 2/1987 Iimura et al. ..... 312/110
5,289,656 A * 3/1994 Vetter ..... 49/250
5,687,506 A * 11/1997 Davies et al. ..... 49/260
6,161,336 A * 12/2000 Ziv-Av ..... 49/260
7,117,637 B2 * 10/2006 Delgado et al. ..... 49/141

FOREIGN PATENT DOCUMENTS

WO WO-89/05389 A1 6/1989
WO WO-90/12183 A1 10/1990

* cited by examiner

*Primary Examiner*—Katherine W Mitchell
*Assistant Examiner*—Michael J Keller
(74) *Attorney, Agent, or Firm*—Harrington & Smith, PC

(57) ABSTRACT

A panel movement system including top and bottom rails having racks with registration teeth along their lengths; top and bottom rail attachments movably attached to respective ones of the rails for lateral movement along lengths of the rails; and a gear movement synchronization system. Each rail attachment includes a rotatable gear engaging the registration teeth on respective ones of the rails. The gear movement synchronization system connects the rotatable gear of the top rail attachment to the rotatable gear of the bottom rail attachment such that the top and bottom rail attachments move along the rails in unison. The top and bottom rail attachments are adapted to have a panel connected therebetween.

16 Claims, 5 Drawing Sheets

ANTI-TILTING, PIVOTABLE, SLIDING PANELS

CROSS REFERENCE TO RELATED APPLICATION

This application claims the benefit under 35 U.S.C. §119 (e) on U.S. provisional patent application No. 60/602,387 filed Aug. 17, 2004, which is hereby incorporated by reference in its entirety.

BACKGROUND OF THE INVENTION

1. Field of the Invention

The invention relates to an anti-tilting mechanism for a pivotable, sliding panel made from any rigid material such as glass, wood, or fiber structure intended for use such as on balconies, verandas, piscine, wall separation, etc.

2. Brief Description of Prior Developments

Traditional glazing for balconies or the like consists of a plurality of sash glass panels mounted on upper and lower guide rail and adapted to slide laterally past one another. A major disadvantage with this type of glazing is that at most only 50 percent of the glazed-in area can be opened. Furthermore, the outer surface of the pane is awkward to clean.

Glazing structures have been proposed in which the panes can be stacked against a side wall of the balcony by pivoting about a vertical axis. In WO 89/05389 this is achieved by means of a double upper rail arrangement having a straight outer rail and an inner rail. Within the curved portion of the inner rail the trailing edge of the pane turns inwards and the pane can opened against the side wall of the balcony. Such an arrangement is, however, not particularly aesthetically pleasing and friction can arise in the system and still be a lot of effort to clean In an effort to eliminate these drawbacks, WO 90/121183 proposes a structure in which the top edge pivot pin of the glass pane is held stationary, no curved guide rail for the trailing edge is required. Whilst eliminating some of the disadvantages of the prior systems, the arrangement according to WO 90/121183 introduces its own drawbacks; one being that the pane must be tilted to disengage the upper trailing wheel from its guide rail before pivoting can commence. Since the leading edge of the pane is locked first only when pivoting has commenced, there is a risk that the trailing wheel may not disengage should the pane topple back before pivoting commences. The fact that the leading edge is locked only once rotation has commenced further implies that a flange protruding from the upper guide rail adjacent the opening for the trailing wheel is required to support the trailing wheel during the initial opening operation. Such protruding flanges hinder the possibility to mount curtains or blinds across the glazing. In addition, because only the upper leading pivot pin is immobilized, the pane cannot be opened through more than 90 degree, due to the fact that the lower leading pivot pin would otherwise be forced along the lower guide rail as a result of the change in position of the center of gravity of the pane.

SUMMARY OF THE INVENTION

The solution to problems described above and the invention can comprise interlocking air-tight panels that are able to slide laterally guided by an upper and a lower rail, while simultaneously pivoting on their axis. It offers many benefits such as easily glass cleaning, frictionless sliding panels, pivoting the panels to serve as doors at any point of the rail, and stacking the panels at any point of the rail.

In accordance with one aspect of the invention, a panel movement system is provided including top and bottom rails having racks with registration teeth along their lengths; top and bottom rail attachments movably attached to respective ones of the rails for lateral movement along lengths of the rails; and a gear movement synchronization system. Each rail attachment includes a rotatable gear engaging the registration teeth on respective ones of the rails. The gear movement synchronization system connects the rotatable gear of the top rail attachment to the rotatable gear of the bottom rail attachment such that the top and bottom rail attachments move along the rails in unison. The top and bottom rail attachments are adapted to have a panel connected therebetween.

In accordance with another aspect of the invention, a panel movement system is provided comprising top and bottom rails; a panel mounted to the rails by top and bottom movement sections to longitudinally slide along the rails, wherein the movement sections comprise rotatable platforms connected to respective top and bottom ends of the panel for allowing the panel to rotate relative to the rails; and a rotation synchronization system connecting the rotatable platform of the top movement section to the rotatable platform of the bottom movement section to rotate the top and bottom rotatable platforms in unison when the panel is rotated relative to the rails.

In accordance with one method of the invention, a method of manufacturing a movable panel system is provided comprising connecting top and bottom movement systems to top and bottom ends of a panel; connecting the movement systems to respective top and bottom rails such that the movement systems can traverse along the rails; and connecting the movement systems to each other such that the top and bottom movement systems operate in registration with each other and traverse along the rails in unison with each other. The movement systems are connected to the panel by rotatable top and bottom platforms to allow the panel to rotate relative to the rails. The method further comprises connecting the movement systems to each other comprises limiting rotation of the top and bottom platforms relative to each other such that the platforms are rotatable in unison with each other.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
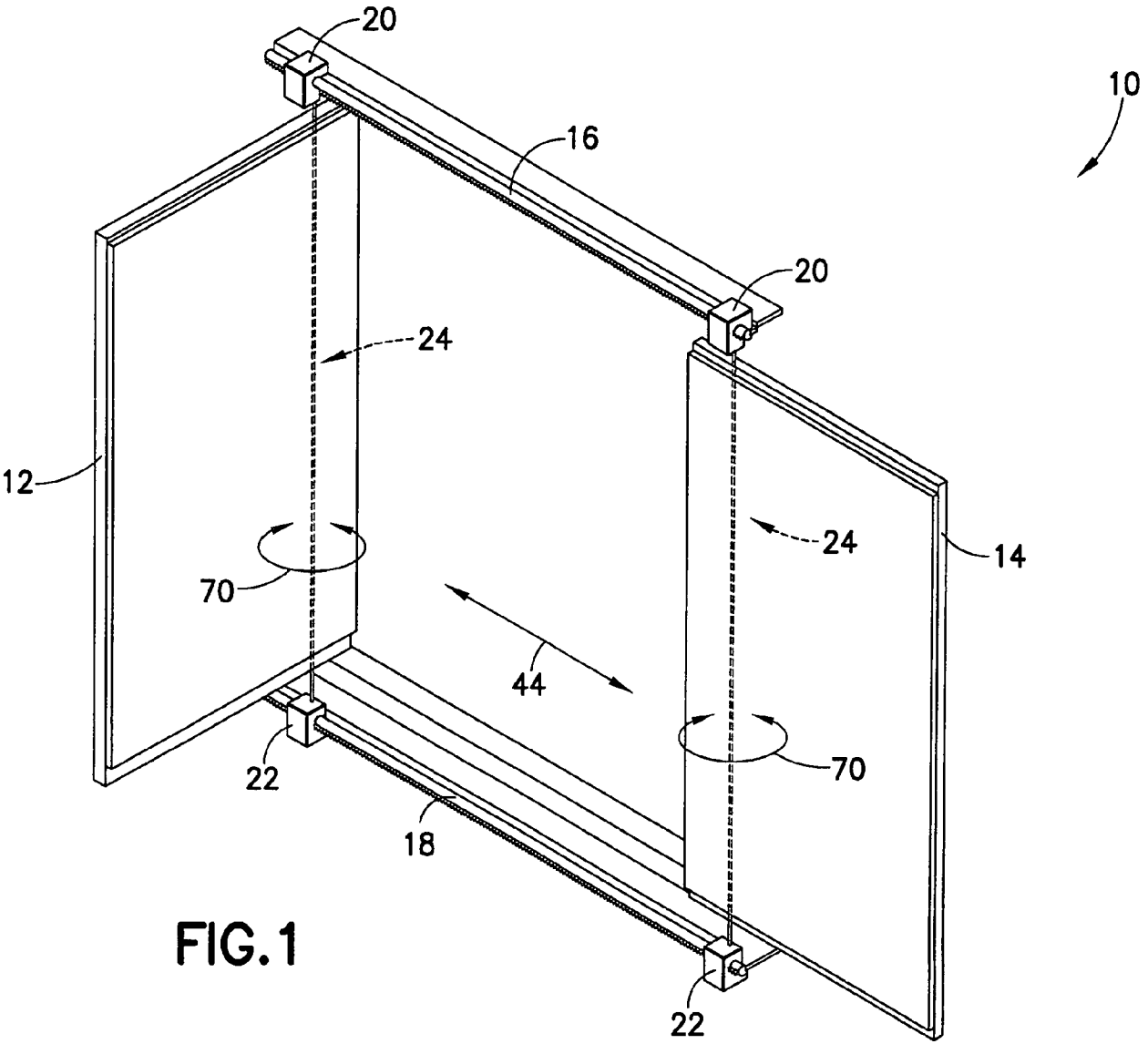
FIG. 1 is a perspective view of a movable panel assembly incorporating features of the invention.

Referring to FIG. 1, there is shown a perspective view of a movable panel assembly 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

The panel assembly 10 in this embodiment is a window or glass door for use in a building. However, in alternate embodiments the invention could be used in any suitable type of assembly where panels are intended to be moved relative to each other. The assembly 12 comprises two panels 12, 14 which are window panes. Non-window panels could be provided. More or less than two movable panels could be provided. The assembly 12 also comprises a frame with two rails 16, 18, top and bottom movement sections 20, 22 for each panel 12, 14, and a synchronization system 24 for each panel 12, 14.

Figure 2:
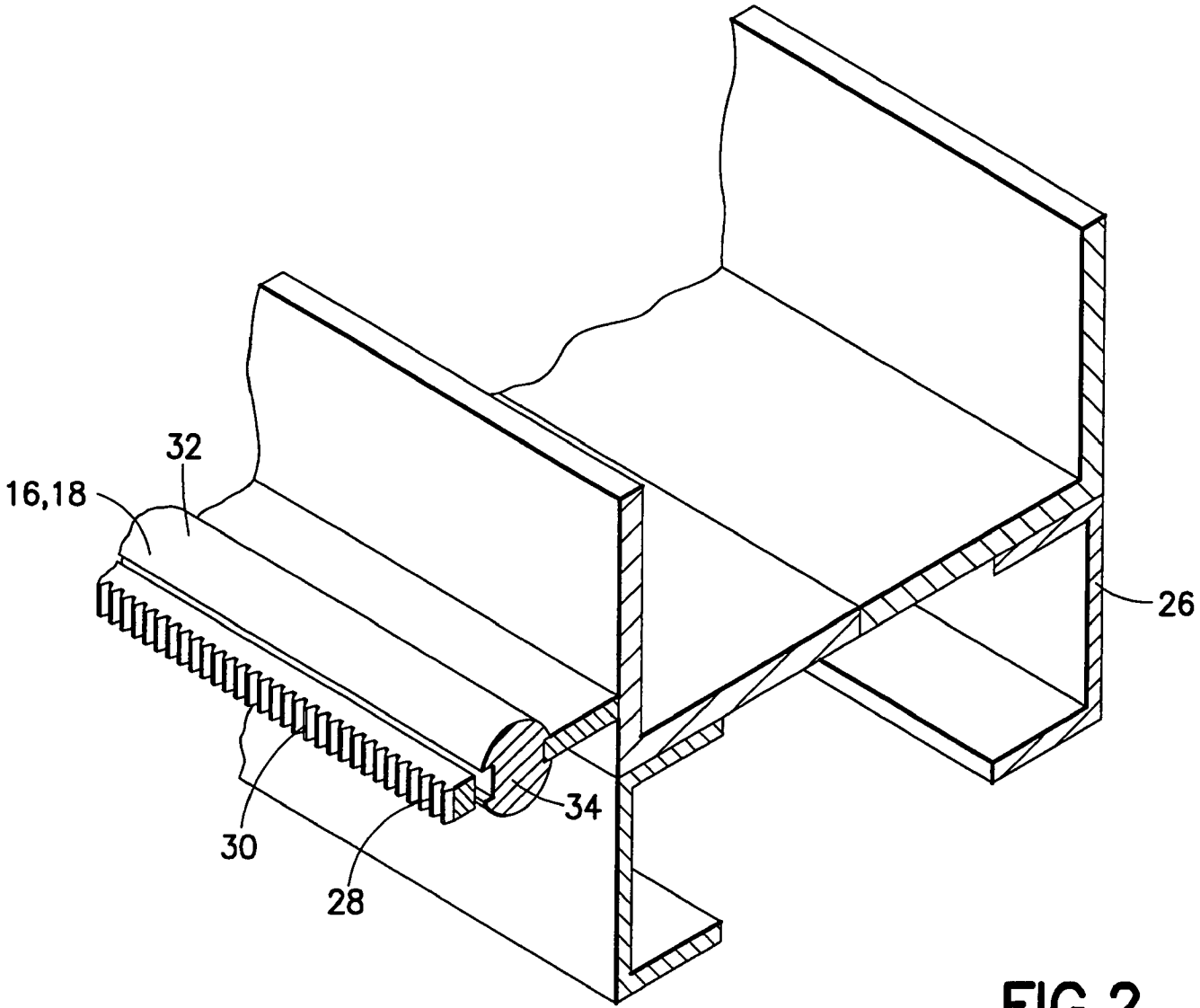
FIG. 2 is a perspective view of a portion of one of the rails of the frame of the assembly shown in FIG. 1.
Figure 3:
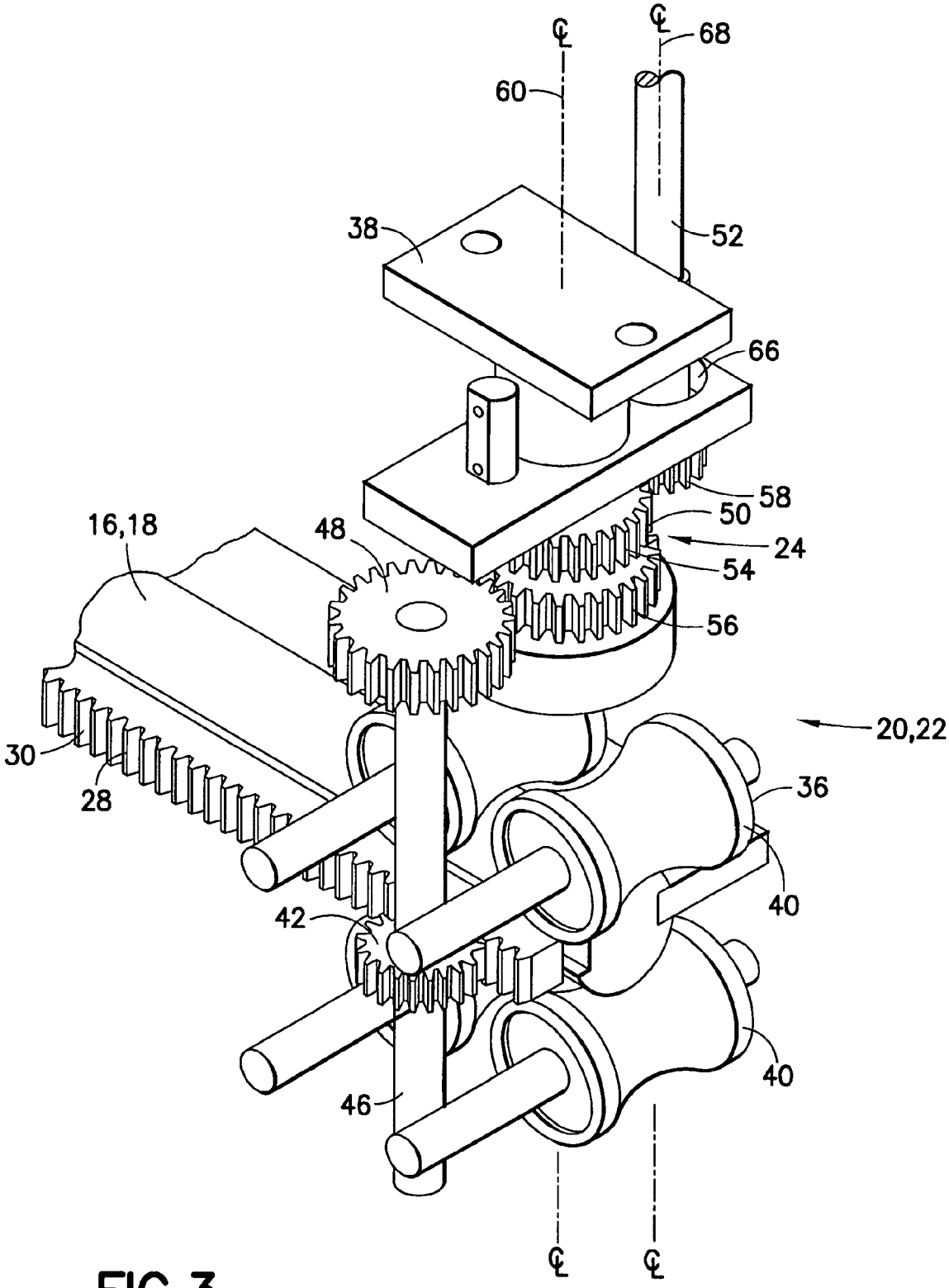
FIG. 3 is a perspective view of components of the assembly shown in FIG. 1.
Figure 4:
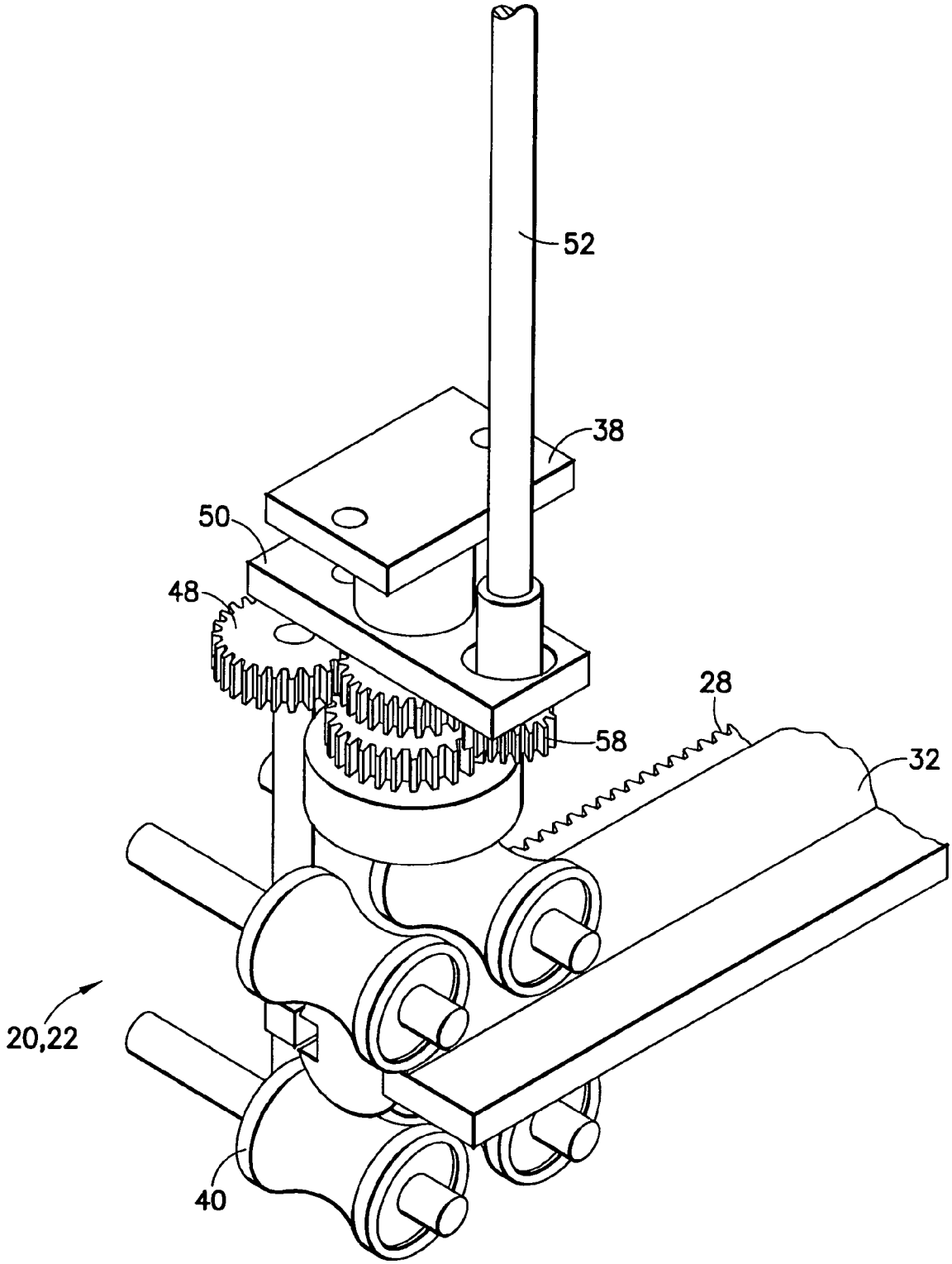
FIG. 4 is a perspective view of the components of the assembly shown in FIG. 3 from an opposite side.
Figure 5:
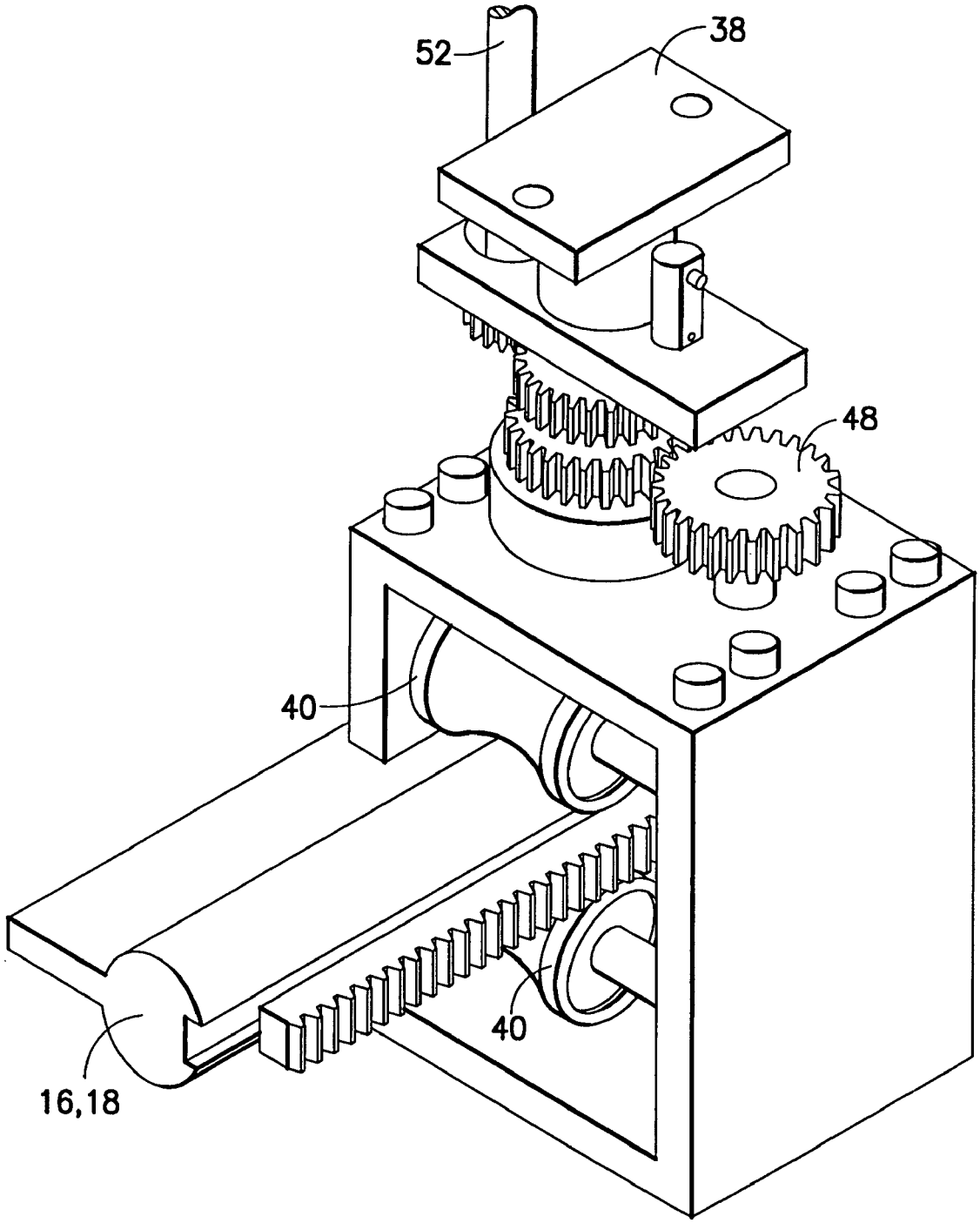
FIG. 5 is a perspective view of the components of the assembly shown in FIGS. 3 and 4 in a gear box frame.

Referring also to FIG. 2, the two rails 16, 18 are identical to each other. In alternate embodiments the rails could be different. The rails 16, 18 extend in a general cantilever fashion from the frame 26. Preferably, the rails 16, 18 extend substantially the entire width of the window. Each rail 16, 18 has a track section with upper and lower convex curved sections 32, 34 and a rack section 28 with registration teeth 30. Referring also to FIGS. 3 and 4, the top and bottom movement systems 20, 22 are identical to each other, but reversely oriented or flipped relative to each other. In alternate embodiments the movement sections could be different from each other. Each panel 12, 14 has the pair of the movement sections 20, 22 attached to its top and bottom ends. The top movement sections 20 are mounted on the top rail 16 and the bottom movement sections 22 are mounted on the bottom rail 18.

Each movement section 20, 22 comprises a rail attachment 36, a panel attachment 38 and part of the synchronization system 24. The rail attachment 36 comprises rollers 40 and a rotatable gear 42. Four rollers 40 are provided; two against the top convex curved section of the rail and two against the bottom convex curved section of the rail. However, in alternate embodiments more or less than two rollers on each top and/or bottom side could be provided. The rollers 40 have a general concave profile to mate with the convex shapes of the rail sections 32, 34. However, in alternate embodiments, any suitable complementary shapes could be provided. The rollers are attached by shafts to a gear box frame of the movement sections 20, 22. The rollers 40 are able to rotate to roll the movement sections 20, 22 along the rails 16, 18. This allows the panel 12, 14 mounted to the rails by a pair of the top and bottom movement sections 20, 22 to longitudinally slide along the rails in general lateral directions as indicated by arrow 44 in FIG. 1.

The rotatable gear 42 is connected to a rotatable shaft 46. The shaft 46 is rotatably mounted to the gear box. An intermediate gear 48 is also connected to the shaft 46. Thus, intermediate gear 48 is rotated when the gear 42 is rotated. The gear 42 has its teeth engaged with the teeth 30 of the rack section 28. The gear 42 forms a pinion in a rack and pinion system. When the panel 12, 14 is longitudinally moved along the rail 16, 18, the gear 42 moves along the length of the rack section 28 and rotates because of interaction between the teeth. This causes the gear 48 to rotate.

The panel attachment 38 comprises a first section 62 adapted to be directly attached to one of the ends of one of the panels 12, 14. The panel attachment 38 also comprises a second section 64 fixedly attached to the first section 62. The second section 64 has a hole 66. A rod 52 of the synchronization system 24 extends through the hole 66. The rod 52 is rotatably mounted in the hole 66 by a bearing such that the rod can axially rotate in the hole. The axis 68 of rotation of the rod 52 is offset from the axis 60 of rotation of the panel attachment 38. The panel attachment 38 can rotate about the axis 60 relative to the gear box.

Synchronization system 24 includes another intermediate gear 50 and the vertical axially rotatable rod 52. The gear 50 is fixed to the gear box for axial rotational movement only about the axis 60. The gear 50 has a top gear section 54 and a bottom gear section 56. The bottom gear section 56 is engaged with the teeth of the gear 48. The top gear section 54 engages teeth of a gear section 58 on the end of the rod 52. The rod 52 has gear sections 58 at both its top and bottom ends.

The rod 52 provides two different types of movement synchronizations. For each panel 12, 14, the respective rod 52 can help synchronize translation movement of the rail attachments 36 of the top and bottom movement sections 20, 22 relative to each other on their respective top and bottom rail 16, 18. In addition, for each panel 12, 14, the respective rod 52 can help synchronize rotational movement of the panel attachments 38 of the top and bottom movement sections 20, 22 relative to each other.

For synchronized translation movement of the rail attachments 36 of the top and bottom movement sections 20, 22 relative to each other on their respective top and bottom rail 16, 18, the rod acts as a mechanical connection between the movement sections 20, 22. The gears 42 of the two movement sections 20, 22 are connected to each other by the respective intermediate gears 48, 50 of the two movement sections 20, 22 and by the rod 52 and its gears 58 at its opposite ends. Thus, as the gear 42 of the bottom movement section 22 moves along the teeth 30 of the bottom rail 18, the two sets of shafts 46 and gears 48, 50, 58, and the rod 52 insure that the gear 42 of the top movement section 20 moves along the teeth 30 of the top rail 16 in the same direction and with the same amount of movement. Likewise, as the gear 42 of the top movement section 20 moves along the teeth 30 of the top rail 16, the two sets of shafts 46 and gears 48, 50, 58, and the rod 52 insure that the gear 42 of the bottom movement section 22 moves along the teeth 30 of the bottom rail 18. This insures a synchronized movement of the top and bottom ends of the panel 12 or 14 along the width of the window. The panel 12, 14 is, thus, prevented from tilting and perhaps jamming during this lateral translation movement.

The panels 12, 14 can also be individually rotated inward and/or outward as indicated by arrows 70 in FIG. 1. For synchronized rotational movement of the panel attachments 38 of the top and bottom movement sections 20, 22 relative to each other, as the panel attachments 38 are rotated along axis 60 at each of the movement sections 20, 22 the gear 50 can remain stationary. The rod 52, because of its connection at the hole 66 to the panel attachment 38, rotates about the axis 60. The teeth of the gear sections 58 rotate about the perimeter of the top gear section 58 resulting in axial rotation of the rod 52 about its axis 68. Thus, as the panel 12 or 14 is rotated open or closed the gear section 58 at the bottom movement section 22 moves along the teeth of the gear 50 of the bottom movement section 22 and the rod 52 axially rotates to insure that the gear section 58 at the top of the rod at the top movement section 20 moves along the teeth of the gear 50 at the top movement section 20 for the top and bottom panel attachments 38 to move in synchronized unison rotation. The rotational movement can also occur at the same time as translational movement if desired.

The invention can comprise interlocking air-tight panels that are able to slide laterally guided by an upper and a lower rail. This can occur with simultaneous pivoting on their axes of rotation 60. This was accomplished by the introduction of specialized gearboxes, located at the extremities of the panels, connecting it to the rails. In order to keep the panel stable while in motion, the gearboxes holding the panels preferably move synchronously else, the panel could be subject to tilting; since one end of the panel may be leading or lagging the other end. The synchronization of the gearbox movements is made possible using a solid beam; the rod 52. The beam 52 connects gear or cog 58 of the lower gearbox with cog 58 of the upper gearbox, enabling them to rotate simultaneously. Rotation of the cog 58 is controlled by a series of other cogs which link it to the rack 28 that lines the rails on which the panel slides aided by the four rollers or pulleys 40.

As the panel is moved laterally, the rack causes pinion 42 to rotate which, in turn, causes the other cogs to rotate relaying rotation to cog 58. Solid beam 52 relays rotation to the upper gearbox. Similarly, the upper gearbox moves the exact distance as that covered by the lower gearbox.

When the panel needs to be rotated on its axis 60, one can simply turn the panel by hand. Cog 58 would travel on the perimeter of cog 50, since the panel is fixed on platform 38 which is secured onto axis 60 known as the synch axis, resulting in the rotation of cog 58. This would cause the simultaneous rotation of both cogs, thus maintaining the vertical parallel position of the beam 52 with respect to the panel; avoiding collision of the beam with the panel while in rotation. The end result is a panel, made out of any rigid material, which can be moved laterally guided by rails, while being simultaneously rotated onto its axis. The panel's motion is smooth and easy to move regardless of its weight. With the invention, the panels 12, 14 can also rotate more than 90 degrees; such as 360 degrees for example. In the embodiment described above, the gears 48 only rotate when the panel laterally slides/rolls along the rails. The platform 38 does not rotate with the gear 48. The platform 38 only rotates when the user pivots the panel and rotation of platform 38 cause gear 58 to circle around the gear section 54. The panels 12, 14 can preferably overlap each other when then are slid towards each other, such as more than 50 percent overlap.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A panel movement system comprising:

top and bottom rails comprising racks with registration teeth along their lengths;

top and bottom rail attachments movably attached to respective ones of the rails for lateral movement along lengths of the rails, wherein each rail attachment comprises a rotatable gear engaging the registration teeth on respective ones of the rails; and a gear movement synchronization system connecting the rotatable gear of the top rail attachment to the rotatable gear of the bottom rail attachment such that the top and bottom rail attachments move along the rails in unison, and wherein the top and bottom rail attachments are adapted to have a panel connected therebetween, wherein at least one of the rail attachments comprises top and bottom rollers located on opposite sides of one of the rails and the top and bottom rollers comprise two top rollers and two bottom rollers for each rail.

2. A panel movement system as in claim 1 wherein at least one rail comprises top and bottom curved sections and edges of the rollers comprise concave shaped profiles configured to contact the curved sections.

3. A panel movement system as in claim 1 wherein the gear movement synchronization system comprises a vertical axially rotatable rod connected to the rotatable gears of the top and bottom rail attachments to each other.

4. A panel movement system as in claim 3 wherein the gear movement synchronization system comprises the top and bottom rail attachments having intermediate gears connecting the rotatable gears to the rotatable rod.

5. A panel movement system as in claim 1 wherein the top and bottom rail attachments each comprise a rotatable platform adapted to be attached to the panel such that the panel can be rotated relative to the rails.

6. A panel movement system as in claim 5 wherein the gear movement synchronization system comprises a vertical axially rotatable rod connected to the rotatable gears of the top and bottom rail attachments to each other, and wherein the rod is mounted to the rotatable platforms to rotate with the platforms.

7. A panel movement system comprising:

top and bottom rails;

a panel mounted to the rails by top and bottom movement sections to longitudinally slide along the rails, wherein the movement sections comprise rotatable platforms connected to respective top and bottom ends of the panel for allowing the panel to rotate relative to the rails; and a rotation synchronization system connecting the rotatable platform of the top movement section to the rotatable platform of the bottom movement section to rotate the top and bottom rotatable platforms in unison when the panel is rotated relative to the rails, wherein a first one of the movements sections comprises top and bottom rollers located on opposite sides of a first one of the rails and the top and bottom rollers comprise two top rollers and two bottom rollers on the rail.

8. A panel movement system as in claim 7 wherein the rotation synchronization system comprises a vertical axially rotatable rod connected to the rotatable platforms, and wherein the rod is axially rotatable on the platforms.

9. A panel movement system as in claim 8 wherein a rotation center axis of the rod is offset from a rotation center axis of the platforms.

10. A panel movement system as in claim 7 wherein the top and bottom movement sections comprise rail attachments movably attached to respective ones of the rails for lateral movement along lengths of the rails.

11. A panel movement system as in claim 10 wherein each rail attachment comprises a rotatable gear engaging registration teeth on respective ones of the rails.

12. A panel movement system as in claim 11 further comprising a gear movement synchronization system connecting the rotatable gear of the top rail attachment to the rotatable gear of the bottom rail attachment such that the top and bottom rail attachments move along the rails in unison.

13. A panel movement system as in claim 12 wherein the rotation synchronization system and the gear movement synchronization system comprise a vertical axially rotatable rod connected to the rotatable platforms, and wherein the rod is axially rotatable on the platforms.

14. A panel movement system as in claim 7 wherein the first rail comprises top and bottom curved sections and edges of the rollers comprise concave shaped profiles configured to contact the curved sections.

15. A method of manufacturing a movable panel system comprising:

connecting top and bottom movement systems to top and bottom ends of a panel;

connecting the movement systems to respective top and bottom rails such that the movement systems can traverse along the rails;

connecting the movement systems to each other such that the top and bottom movement systems operate in registration with each other and traverse along the rails in unison with each other, wherein the movement systems are connected to the panel by rotatable top and bottom platforms to allow the panel to rotate relative to the rails, and wherein connecting the movement systems to each other comprises limiting rotation of the top and bottom platforms relative to each other such that the platforms are rotatable in unison with each other wherein the panel system comprises top and bottom rail attachments with at least one of the rail attachments comprising top and bottom rollers located on opposite sides of one of the rails, wherein the top and bottom rollers comprise two top rollers and two bottom rollers for each rail.

16. A panel movement system comprising:

top and bottom rails comprising racks with registration teeth along their lengths;

top and bottom rail attachments movably attached to respective ones of the rails for lateral movement along lengths of the rails, wherein each rail attachment comprises a rotatable gear engaging the registration teeth on respective ones of the rails; and a gear movement synchronization system connecting the rotatable gear of the top rail attachment to the rotatable gear of the bottom rail attachment such that the top and bottom rail attachments move along the rails in unison, and wherein the top and bottom rail attachments are adapted to have a panel connected therebetween, wherein the gear movement synchronization system comprises a vertical axially rotatable rod connected to the rotatable gears of the top and bottom rail attachments to each other and the gear movement synchronization system comprises the top and bottom rail attachments having intermediate gears connecting the rotatable gears to the rotatable rod.

* * * * *